US006070819A

United States Patent [19]

Young et al.

[11] Patent Number: 6,070,819

[45] Date of Patent: Jun. 6, 2000

[54] APPARATUS FOR CONTROLLING THE ADJUSTING RODS OF A CRUSHER

[75] Inventors: Gregory A. Young, Cedar Rapids; Albert D. Botton, Marion, both of Iowa

[73] Assignee: Cedarapids, Inc., Cedar Rapids, Iowa

[21] Appl. No.: 09/274,712

[22] Filed: Mar. 22, 1999

[51] Int. Cl.[7] ..... B02C 13/282

[52] U.S. Cl. ..... 241/189.1; 241/285.3; 241/287

[58] Field of Search ..... 241/189.1, 286–290, 241/285.2, 285.3

[56] References Cited

U.S. PATENT DOCUMENTS

| | | | |
|---|---|---|---|
| 4,017,035 | 4/1977 | Stuttman | 241/189.1 |
| 5,890,666 | 4/1999 | Folling et al. | 241/285.3 |

*Primary Examiner*—Mark Rosenbaum
*Attorney, Agent, or Firm*—Marshall, O'Toole, Gerstein, Murray & Borun

[57] ABSTRACT

An apparatus is disclosed for controlling the movement of the adjusting rods of a horizontal shaft impact crusher when the crusher is opened for service or the like. The disclosed apparatus includes a guide mounted to the crusher and defining a cavity. The cavity receives an adjusting rod and is dimensioned to force the adjusting rod to pivot in a predetermined direction when the crusher is opened.

16 Claims, 5 Drawing Sheets

APPARATUS FOR CONTROLLING THE ADJUSTING RODS OF A CRUSHER

FIELD OF THE INVENTION

The invention relates generally to horizontal shaft impact crushers, and, more particularly, to apparatus for controlling the movement of the adjusting rods of such a crusher when the crusher is opened for service or the like.

BACKGROUND OF THE INVENTION

Horizontal shaft impact crushers are commonly employed to pulverize many different types of materials including, by way of examples, not limitations, asphalt, concrete, and rock. Such crushers typically include a frame defining a cavity. A rotating impeller driven by an external drive mechanism is disposed within the cavity. The frame includes an opening through which the material to be crushed is inserted into the cavity. One or more breaker plates are generally disposed within the cavity. The rotating impeller repeatedly throws the material to be crushed against the breaker plate(s) thereby breaking the material into small particles.

Each of the breaker plates is generally pivotally mounted within the cavity such that its angular position may be changed to suit the type of material being crushed. To this end, each breaker plate is typically supported within the cavity by a number of adjusting rods (typically two). The adjusting rods extend out of the frame. By adjusting the position of the rods (e.g., pulling the rods further out of the cavity or pushing them further into the cavity), an operator can adjust the position of the associated breaker plate.

Many horizontal shaft impact crushers are provided with a split housing which can be opened to facilitate servicing of the rotor, liners, and other internal components. Such split housings typically include an upper housing portion joined to a lower housing portion through a hinged connection. Due to portable plant width considerations, the motors for these prior art crushers are generally located in line with the crusher frame. As a result, when the upper housing or frame portion is pivoted open, the pivoting frame section typically swings toward the electric or diesel drive motor.

As the upper housing section is so pivoted, the pivoting breaker plates inside the frame move under the influence of gravity such that the adjusting rods extend much farther out of the housing than when the housing is in the normal operating position. When the adjusting rods are so extended, they may contact the motor thereby creating the possibility of damage to the adjusting rods and/or the motor during servicing.

The present invention is arranged to reduce the amount and/or alter the angle of extension of the adjusting rods.

SUMMARY OF THE INVENTION

In accordance with an aspect of the invention, an apparatus is provided for use with a horizontal shaft impact crusher having a frame defining a cavity, a breaker plate and a pair of adjusting rods supporting the breaker plate within the cavity. The adjusting rods have a longitudinal axis. The apparatus comprises a housing and a first chamber defined in the housing. The first chamber has a width sufficient to slidably receive an adjusting rod and a length dimensioned to permit movement of the adjusting rod through a first distance in a direction transverse to the longitudinal axis of the adjusting rod. The apparatus also includes a second chamber defined in the housing. The second chamber is disposed in communication with the first chamber, and has a width sufficient to slidably receive the adjusting rod and a length dimensioned to permit movement of the adjusting rod through a second distance in a direction transverse to the longitudinal axis. The second distance is shorter than the first distance.

In accordance with another aspect of the invention, an apparatus is provided for use with a horizontal shaft impact crusher having a frame defining a cavity. The apparatus includes an adjusting rod having a first end disposed within the cavity, a second end extending out of the cavity, and a longitudinal axis. The apparatus also includes a housing and a chamber defined in the housing. The chamber has a first opening and a second opening. The first and second openings are disposed on opposite sides of the chamber. The adjusting rod is slidably disposed in each of the first and second openings such that, applying a force to the first end of the adjusting rod in a direction transverse to the longitudinal axis of the adjusting rod causes the adjusting rod to pivot about an edge surface of the first opening.

In accordance with still another aspect of the invention, an apparatus includes a horizontal shaft impact crusher having a frame defining a cavity. The frame of the crusher has a first portion and a second portion. The first portion is mounted for pivoting motion relative to the second portion. A breaker plate is disposed within the cavity, and an adjusting rod supports the breaker plate within the cavity. The adjusting rod has a first end disposed within the cavity, a second end extending out of the cavity, and a longitudinal axis. A guide is secured to the frame of the crusher. The guide defines a chamber having a first opening and a second opening. The first and second openings are disposed on opposite sides of the chamber. The first opening is in communication with the cavity. The adjusting rod is slidably disposed in at least the first opening such that, pivoting the first portion of the crusher frame relative to the second portion applies a force to the first end of the adjusting rod in a direction transverse to the longitudinal axis of the adjusting rod which thereby causes the adjusting rod to pivot about an edge surface of the first opening.

In accordance with yet another aspect of the invention, an apparatus includes a horizontal shaft impact crusher having a frame defining a cavity. The frame of the crusher has a first portion and a second portion. The first portion is mounted for pivoting motion relative to the second portion. An adjusting rod has a first end disposed within the cavity, a second end extending out of the cavity, and a longitudinal axis. A guide is secured to the frame of the crusher and defines a chamber in communication with the cavity. The adjusting rod is slidably disposed in the chamber. The chamber is dimensioned to force the adjusting rod to pivot in a predetermined direction when the first portion of the crusher frame is pivoted relative to the second portion of the crusher frame.

Other features and advantages are inherent in the apparatus claimed and disclosed or will become apparent to those skilled in the art from the following detailed description and its accompanying drawings.

DESCRIPTION OF THE PREFERRED EMBODIMENTS

Figure 1:
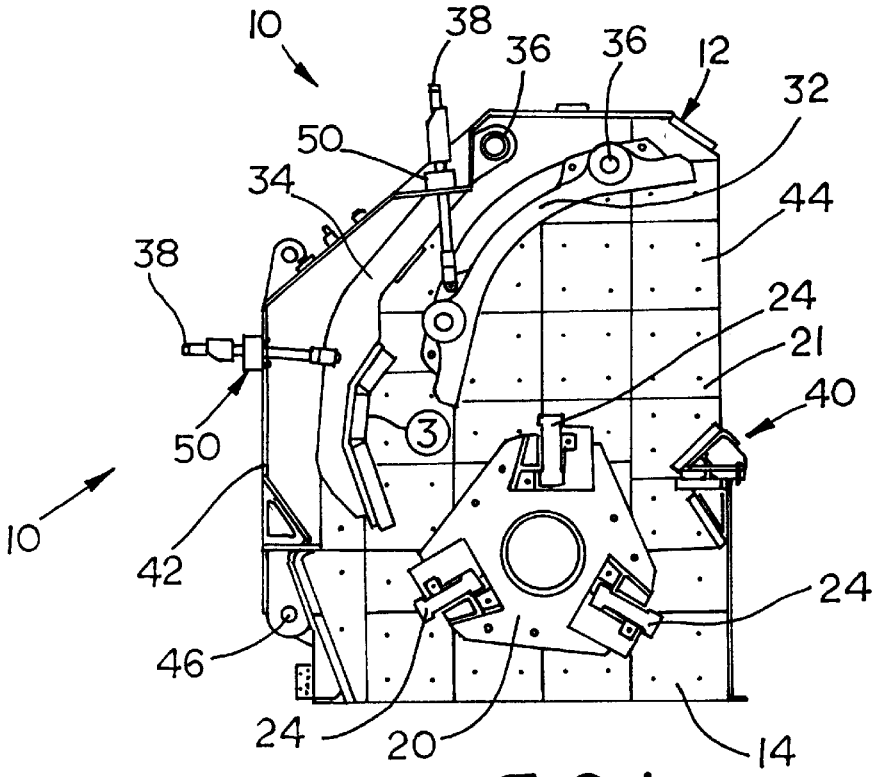
FIG. 1 is a schematic illustration, partly in section, of a horizontal shaft impact crusher employing apparatus constructed in accordance with the teachings of the instant invention for controlling the adjusting rods of the crusher.
Figure 2:
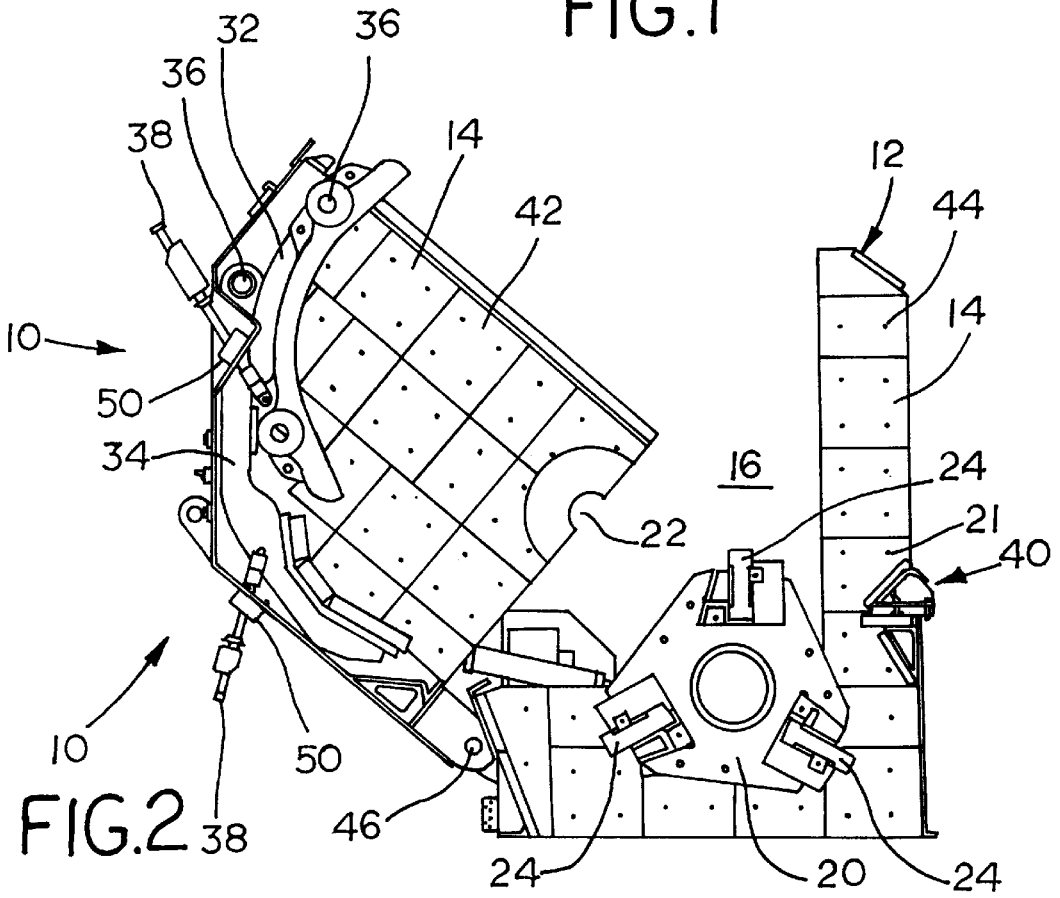
FIG. 2 is an illustration similar to FIG. 1 but showing the crusher opened for servicing.

Apparatus 10 constructed in accordance with the teachings of the invention are shown in FIGS. 1 and 2 in a preferred environment of use, namely, mounted on a horizontal shaft impact crusher 12. While for clarity of illustration, the apparatus 10 are shown herein mounted on a specific type of crusher 12, persons of ordinary skill in the art will readily appreciate that the teachings of the invention are in no way limited to use with that crusher 12 or to any other particular environment of use. On the contrary, apparatus constructed in accordance with the teachings of the invention may be used with any crusher which would benefit from the advantages they offer without departing from the scope or spirit of the invention.

The illustrated crusher 12 is a horizontal shaft impact crusher. Thus, as is well known in the art, the crusher 12 includes a frame or housing 14 that defines an internal cavity 16. An impeller 20 is journalled in a bearing (not shown) mounted adjacent an opening 22 in the frame 14 (see FIG. 2). As shown in FIGS. 1 and 2, the impeller 20 is provided with a plurality of bars or hammers 24 for striking and propelling aggregate material. The impeller 20 is mounted for rotation within the cavity 16 in a generally horizontal position and is coupled to a drive mechanism (not shown) through a gear train (not shown) which imparts rotational movement to the impeller 20 in a conventional manner. Material to be crushed is inserted into the cavity through an insertion opening 21 defined in the frame 14.

In order to provide a striking surface to break material propelled by the impeller 20 within the cavity 16, the crusher 12 is further provided with conventional breaker plates 32, 34. As is conventional, the illustrated crusher 12 has a primary breaker plate 32 and a secondary breaker plate 34, both of which are suspended within the cavity 16 adjacent the motion path of the impeller hammers 24. When material is inserted into the crusher 12, the impeller 20 strikes and propels the material against the breaker plates 32, 34. As shown in FIGS. 1 and 2, one end of each of the breaker plates 32, 34 is mounted to the housing for pivoting motion by a conventional pivot pin 36 journalled in bearings. The opposite ends of the breaker plates 32, 34 are suspended within the cavity 16 by adjusting rods 38. One end of the adjusting rods 38 are secured to the breaker plates 32, 34 within the cavity 16. As shown in FIG. 1, the other end of the rods 38 extend out of the crusher 12. By adjusting the position of the adjusting rods 38 (i.e., by pushing the rods 38 further into the cavity 16, or by pulling the rods 38 a further distance out of the cavity 16), one can adjust the position of the breaker plates 32, 34 within the cavity 16 by rotating the respective plate 32, 34 about its pivot point 36.

For the purpose of supplying material to be crushed to the cavity of the crusher 12, a feed plate 40 is mounted to a shelf formed by the crusher frame 14 adjacent the insertion opening.

As shown in FIG. 2, the illustrated crusher frame 14 includes an upper portion 42 and a lower portion 44 which are joined by a hinged connection 46 of conventional design. As also shown in FIG. 2, when the upper frame 42 is pivoted away from the lower frame 44 for maintenance or the like, the breaker plates 32, 34 rotate about their pivot points 36 under the influence of gravity. This rotational movement applies forces to the adjusting rods 38. These forces have both longitudinal components (i.e., along the longitudinal axis of the adjusting rods 38) and lateral components (i.e., transverse to the longitudinal axis of the adjusting rods 38). Since conventional adjusting rods 38 generally include a one way adjustable stop that limits the distance the rods 38 may move into the cavity 16 but places no restriction on the distance the rods 38 may move out of the cavity 16, the rods 38 respond to the longitudinal force components by moving further distances out of the cavity 16 (i.e., extending further from the crusher housing 14).

For the purpose of controlling the movements of the adjusting rods 38 as the upper frame 42 of the crusher 12 is pivoted relative to the lower frame 44, the apparatus 10, in accordance with the present invention, is further provided with a plurality of guides 50. Each of the guides 50 is associated with one of the adjusting rods 38 and is secured to the crusher frame 14 at the point where its associated rod 38 exits the cavity 16. The guides 50 can be fixed to the crusher frame 14 by bolting, riveting, welding or by employing another suitable fastening technique.

Figure 3:
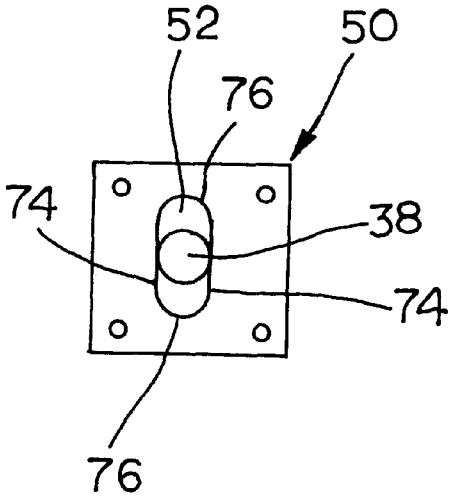
FIG. 3 is a top plan view of an apparatus constructed in accordance with the teachings of the invention.
Figure 4:
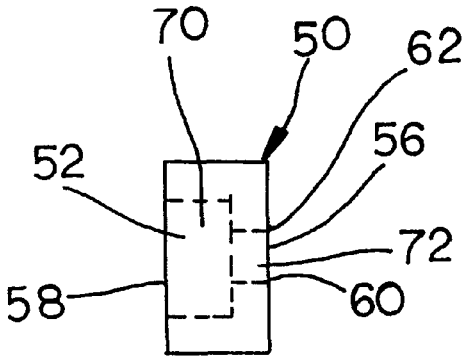
FIG. 4 is a side elevational view of the apparatus of FIG. 3.

Turning to FIGS. 3 and 4, each guide 50 preferably comprises a block or housing defining a chamber 52. The chamber 52 is open ended such that, when the guide 50 is mounted to the frame 14, the chamber 52 is in open communication with the cavity 16. The chamber 52 is dimensioned to slidably receive an adjusting rod 38 with some play such that the adjusting rod 38 can enter an opening 56 on one side of the chamber 52 and exit an opening 58 on the opposite side of the chamber 52.

Significantly, the chamber 52 is dimensioned to force the received adjusting rod 38 to pivot in a predetermined direction when the upper portion 42 of the crusher frame 14 is pivoted relative to the lower portion 44 of the frame 14. More specifically, the chamber 52 is dimensioned such that, when the upper frame 42 is pivoted relative to the lower frame 44 as shown in FIG. 2 such that the breaker plate 32 pivots about its pivot point 36 under the force of gravity. Consequently, the chamber 52 applies a force to the end of the adjusting rod 38 within the cavity 16 in a direction transverse to the longitudinal axis of the adjusting rod, such that the guide 50 forces the adjusting rod 38 to pivot about an end surface (e.g., either surface 60 or 62 in FIG. 4) of the chamber opening 56.

Persons or ordinary skill in the art will readily appreciate that there are many different ways to configure the chamber 52 and the housing 50 in accordance with the teachings of the invention. Exemplary configurations are shown in FIGS. 3–9, with the presently preferred approach shown in FIGS. 7–9.

In the embodiments shown in FIGS. 3–6, the chamber 52 comprises two chambers 70, 72. In all of these embodiments, the distal chamber 70 (with respect to the upper frame 42) has a width sized to slidably receive an adjusting rod 38 and a length dimensioned to permit the rod 38 to move through a predetermined distance in a direction generally transverse to its longitudinal axis. The proximal chambers 72 (with respect to the upper frame 42) of the devices also have a width sufficient to slidably receive the adjusting rod 38 and a length dimensioned to permit movement of the rod 38 over a distance shorter than the distance permitted by the distal chamber 70.

As shown in FIGS. 3 and 4, the distal chamber 70 is defined by two generally straight walls 74 and two semi-circular walls 76. As shown in FIG. 4, the opposite walls 74, 76 are generally parallel.

Figure 5:
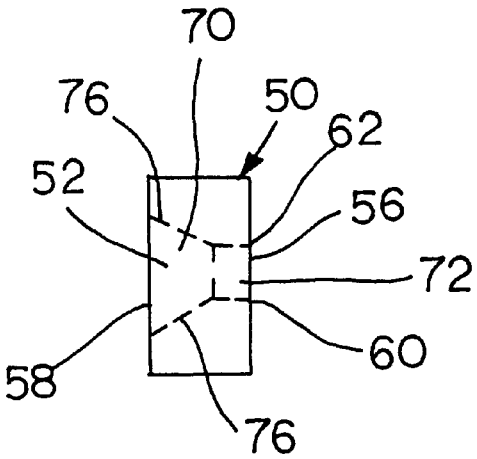
FIG. 5 is a side elevational view of another apparatus constructed in accordance with the teachings of the invention.

The embodiment shown in FIG. 5 is similar to that shown in FIGS. 3 and 4 in that it includes two straight walls and two semi-circular walls 76. In the FIG. S embodiment, however, the walls 76 of semi-circular cross-section are tapered or flared toward the distal opening of the proximal chamber 72.

Figure 6:
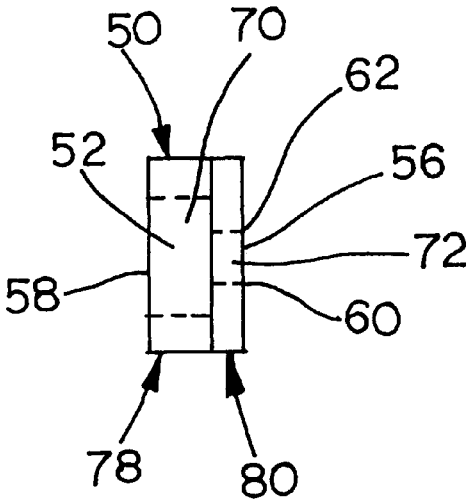
FIG. 6 is a side elevational view of still another apparatus constructed in accordance with the teachings of the invention.

The embodiment shown in FIG. 6 is similar to that shown in FIG. 4 in that it excludes flared or tapered walls. However, the embodiment shown in FIG. 6 includes a distal chamber 70 having a rectangular cross-section (i.e., it does not have walls with a semi-circular cross-section).

Person of ordinary skill in the art will readily appreciate that, while the proximal chamber 72 of any of the embodiments shown in FIGS. 3–6 could have a rectangular cross-section, it is currently preferred to employ proximal chambers 72 with circular cross-sections. Such persons will also appreciate that, the guide 50 may be implemented as a unitary structure as shown in FIGS. 3–5, or it may be implemented by two or more portions 78, 80 as shown in FIG. 6.

Figure 7:
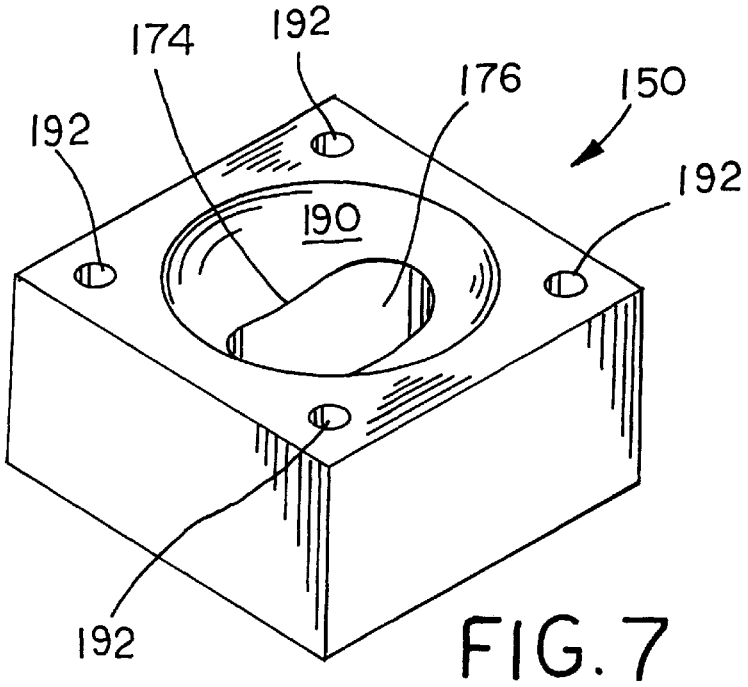
FIG. 7 is a perspective view of yet another apparatus constructed in accordance with the teachings of the invention.
Figure 8:
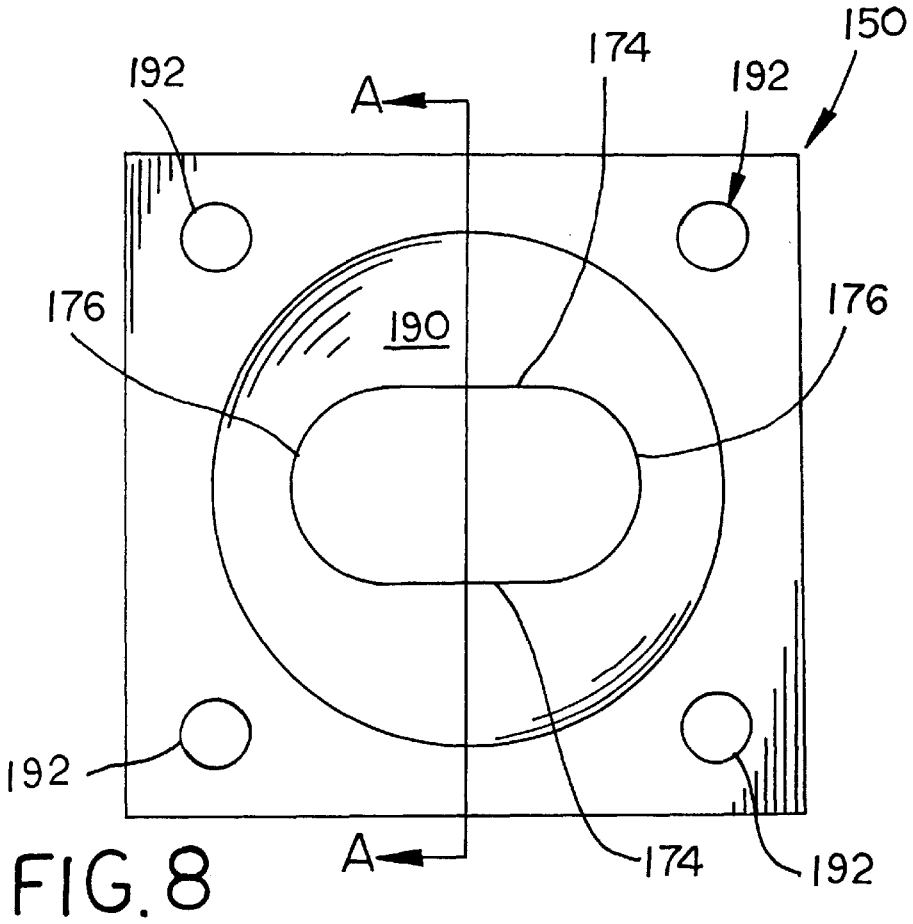
FIG. 8 is a top plan view of the apparatus of FIG. 7.
Figure 9:
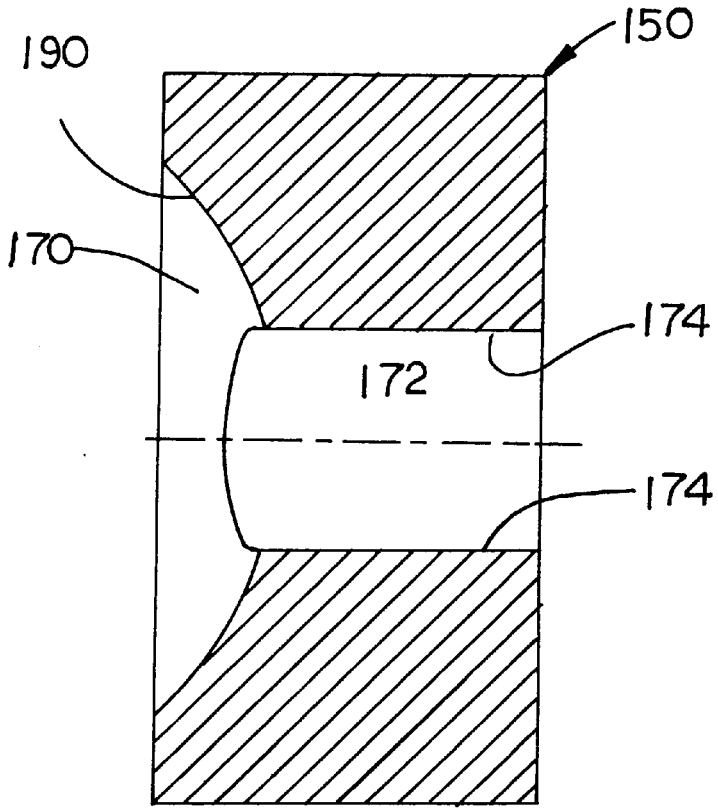
FIG. 9 is a cross-sectional view of the apparatus of FIG. 7 taken along lines A—A of FIG. 8.

The preferred guide 150 shown in FIGS. 7–9 has a unitary housing with a distal chamber 170 and a proximal chamber 172. As shown in FIGS. 7 and 8, the proximal chamber 172 of the preferred guide 150 has two straight walls 174 and two walls 176 with semi-circular cross-sections. The walls 174, 176 are not flared. The opposite walls 174, 176 are generally parallel to one another. The openings of the chamber 172 are, thus, substantially identical.

The distal chamber 170 of the preferred guide 150 forms a shallow, semi-hemispherical depression 190.

As shown in FIGS. 7 and 8, the preferred guide 150 includes four bores 192 which are dimensioned to receive conventional fasteners such as bolts to removably secure the guide 150 to the crusher frame 14.

Figure 10:
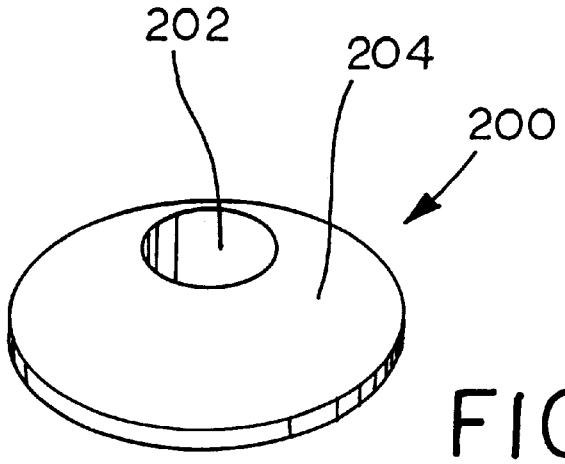
FIG. 10 is a perspective view of a washer for use with the apparatus of FIG. 7.
Figure 11:
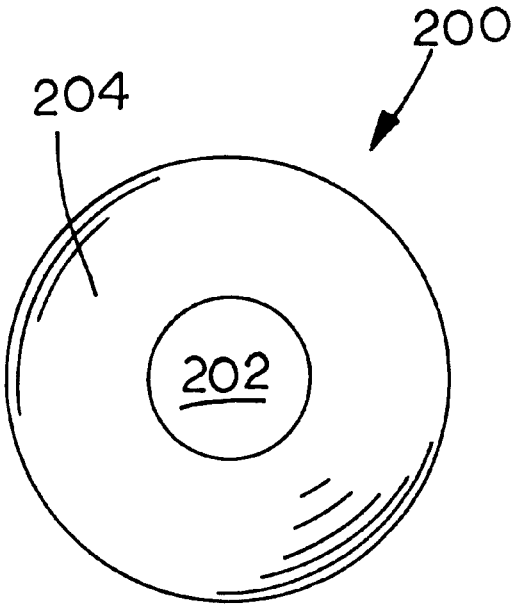
FIG. 11 is a top plan view of the washer of FIG. 10.
Figure 12:
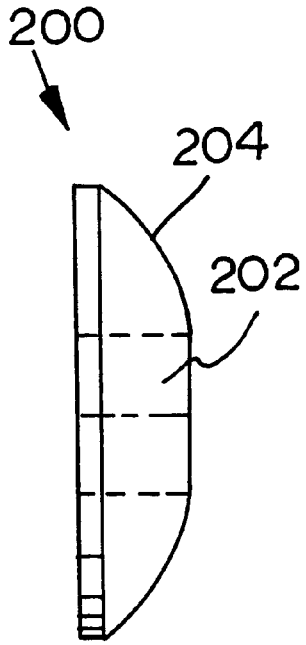
FIG. 12 is a side elevational view of the washer of FIGS. 10 and 11.

For the purpose of aligning the rod 38 in the guide 150, the apparatus 10 is preferably provided with a washer 200. As shown in FIGS. 10–12, the washer 200 has a circular perimeter and defines a central bore 202 which is sized to receive an adjusting rod 38. Preferably, the washer 200 has a curved outer surface 204 which is dimensioned to mate with the distal chamber 170 of the preferred guide 150 shown in FIGS. 7–9.

From the foregoing, persons of ordinary skill in the art will appreciate that the disclosed guides 50, 150 advantageously cause the adjusting rods 38 to fold away from the in-line motor of a crusher 12 when the crusher 122 is opened for service. The guides 50, 150, thus, act as pivot points to reduce the envelope of the crusher 12 when the crusher is opened for service.

Preferably, the guides 50, 150 are implemented using a material which does not suffer undue wear from contact with the adjusting rod threads and which does not damage the threads. In the presently preferred embodiment, the guides 50, 150 are implemented using Nylatron GSM® which is commercially available from DSM Engineering Plastic Products. To further address these wear issues, the washer 200 is manufactured of AISC 1020 hot rolled steel.

While, as explained above, the guides 50, 150 can be manufactured in many ways and configurations without departing from the scope or spirit of the invention, it is preferred that the guide hole of the guides 50, 150 taper out to a slot to allow for the range of motion required for the adjusting rod 38 during the crushing operation.

Although certain instantiations of the teachings of the invention have been described herein, the scope of coverage of this patent is not limited thereto. On the contrary, this patent covers all instantiations of the teachings of the invention fairly falling within the scope of the appended claims either literally or under the doctrine of equivalents.

What is claimed is:

1. For use with a horizontal shaft impact crusher having a frame defining a cavity, a breaker plate and a pair of adjusting rods supporting the breaker plate within the cavity, each of the adjusting rods having a longitudinal axis, the adjusting rods extending out of the cavity, an apparatus comprising:

a housing;

a first chamber defined in the housing, the first chamber having a width sufficient to slidably receive an adjusting rod and a length dimensioned to permit movement of the adjusting rod through a first distance in a direction transverse to the longitudinal axis of the adjusting rod; and a second chamber defined in the housing and being disposed in communication with the first chamber, the second chamber having a width sufficient to slidably receive the adjusting rod and a length dimensioned to permit movement of the adjusting rod through a second distance in a direction transverse to the longitudinal axis, the second distance being shorter than the first distance.

2. An apparatus as defined in claim 1 wherein the first chamber is rectangular in cross-section.

3. An apparatus as defined in claim 1 wherein the first chamber is circular in cross-section.

4. An apparatus as defined in claim 1 wherein the second chamber is rectangular in cross-section.

5. An apparatus as defined in claim 1 wherein the second chamber is circular in cross-section.

6. An apparatus as defined in claim 1 wherein the first chamber is defined by two substantially straight walls and two flared walls.

7. An apparatus as defined in claim 6 wherein the flared walls have a semi-circular cross-section.

8. For use with a horizontal shaft impact crusher having a frame defining a cavity, an apparatus comprising:

an adjusting rod having a first end disposed within the cavity, a second end extending out of the cavity, and a longitudinal axis;

a housing;

a chamber defined in the housing, the chamber having a first opening and a second opening, the first and second openings being disposed on opposite sides of the chamber, the adjusting rod being slidably disposed in each of the first and second openings, wherein applying a force to the first end of the adjusting rod in a direction transverse to the longitudinal axis of the adjusting rod causes the adjusting rod to pivot about an edge surface of the first opening.

9. An apparatus as defined in claim 8 wherein the first and second openings are substantially identical.

10. An apparatus as defined in claim 8 wherein the housing further includes a second chamber, the second chamber being in communication with the first chamber.

11. An apparatus as defined in claim 10 further comprising a washer mounted upon the adjusting rod.

12. An apparatus as defined in claim 11 wherein the washer is dimensioned to mate with the second chamber.

13. An apparatus as defined in claim 8 further comprising a washer mounted upon the adjusting rod.

14. An apparatus comprising:

a horizontal shaft impact crusher having a frame defining a cavity, the frame of the crusher having a first portion and a second portion, the first portion being mounted for pivoting motion relative to the second portion;

a breaker plate disposed within the cavity;

an adjusting rod supporting the breaker plate within the cavity, the adjusting rod having a first end disposed within the cavity, a second end extending out of the cavity, and a longitudinal axis;

a guide secured to the frame of the crusher, the guide defining a chamber having a first opening and a second opening, the first and second openings being disposed on opposite sides of the chamber, the first opening being in communication with the cavity, the adjusting rod being slidably disposed in at least the first opening, wherein pivoting the first portion of the crusher frame relative to the second portion applies a force to the first end of the adjusting rod in a direction transverse to the longitudinal axis of the adjusting rod which thereby causes the adjusting rod to pivot about an edge surface of the first opening.

15. An apparatus as defined in claim 14 wherein the force comprises gravity pulling on the breaker plate.

16. An apparatus comprising:

a horizontal shaft impact crusher having a frame defining a cavity, the frame of the crusher having a first portion and a second portion, the first portion being mounted for pivoting motion relative to the second portion;

an adjusting rod having a first end disposed within the cavity, a second end extending out of the cavity, and a longitudinal axis;

a guide secured to the frame of the crusher, the guide defining a chamber in communication with the cavity, the adjusting rod being slidably disposed in the chamber, the chamber being dimensioned to force the adjusting rod to pivot in a predetermined direction when the first portion of the crusher frame is pivoted relative to the second portion of the crusher frame.

* * * * *